United States Patent [19]

Tucci et al.

[11] 4,037,223

[45] July 19, 1977

[54] AUDIBLE ALARM SYSTEM FOR AN ELECTRICAL OUTLET

[75] Inventors: Domenick Tucci, Mount Kisco; Lewis Cantalupi, Yonkers, both of N.Y.

[73] Assignee: Tucci Corporation, Harrison, N.Y.

[21] Appl. No.: 564,131

[22] Filed: Apr. 1, 1975

[51] Int. Cl.[2] ..... G08B 21/00

[52] U.S. Cl. ..... 340/280; 340/283; 340/310 CP

[58] Field of Search ..... 340/280, 283, 274, 275; 200/42 R, 51 R, 38 FB, 61.93; 174/48, 67; 339/36, 37, 77, 79

[56] References Cited

U.S. PATENT DOCUMENTS

| | | | |
|---|---|---|---|
| 2,439,708 | 4/1948 | Abraham | 200/50 A |
| 2,916,733 | 12/1959 | Hirsch | 340/280 |
| 3,090,948 | 5/1963 | Cremer | 340/280 |
| 3,714,616 | 1/1973 | Sample | 174/67 X |

*Primary Examiner*—Thomas B. Habecker
*Attorney, Agent, or Firm*—Morgan, Finnegan, Pine, Foley & Lee

[57] ABSTRACT

An audible alarm system for an electrical outlet including a housing dimensioned to prevent access to the socket of an electrical outlet upon insertion therein, means coupled to the housing for insertion into a socket, alarm means in the housing for providing an audible alarm, and pressure responsive switch means for normally completing a circuit to the alarm means to activate the same. The pressure responsive switch means having an outwardly extending member for engagement and depression by the electrical outlet upon insertion into a socket to open the circuit to the alarm means and deactivate the same; release of the outwardly extending member during withdrawal of the housing from the socket causing the pressure responsive switch means to close the circuit to the alarm means to provide an audible alarm.

8 Claims, 4 Drawing Figures

AUDIBLE ALARM SYSTEM FOR AN ELECTRICAL OUTLET

The present invention relates to audible alarm systems, and more specifically to an audible alarm system for an electrical outlet.

When electrical outlets are not in use, the plug sockets present a hazard to curious children who may attempt to poke their fingers or objects such as screwdrivers or toys into the plug holes of the sockets. The general approach to preventing access to the plug sockets is to insert individual plastic members in each socket. However, such plastic members may be removed by children and once removed there is nothing to prevent the child from tampering with the hazardous plug socket.

It is an object of the present invention to provide an audible alarm system for electrical outlets.

It is a further object of the present invention to provide an audible alarm system for electrical outlets which provides an audible sound to indicate that a child is tampering with the electrical outlet.

It is a still further object of the present invention to provide an audible alarm system for electrical outlets which emits an unpleasant sound for discouraging children from tampering with an electrical outlet.

It is a still further object of the present invention to provide an audible alarm system having a housing dimensioned to cover a single plug socket or a plug socket pair, as desired.

Briefly, the audible alarm system for electrical outlets in accordance with the present invention includes a housing dimensioned to prevent access to the socket of an electrical outlet upon insertion therein, means coupled to the housing for insertion into a socket, alarm means in the housing for providing an audible alarm, pressure responsive switch means for normally closing a circuit to the alarm means for activating the same. The pressure responsive switch means having an outwardly extending member for engagement and depression by the electrical outlet upon insertion into a socket to open the circuit to the alarm means and deactivate the same; release of the outwardly extending member during withdrawal of the housing from the socket causes the pressure responsive switch means to close the circuit to the alarm means to provide an audible alarm.

Other objects, aspects, and advantages of the present invention will be apparent when the detailed description is considered with the drawings.

Figure 1:
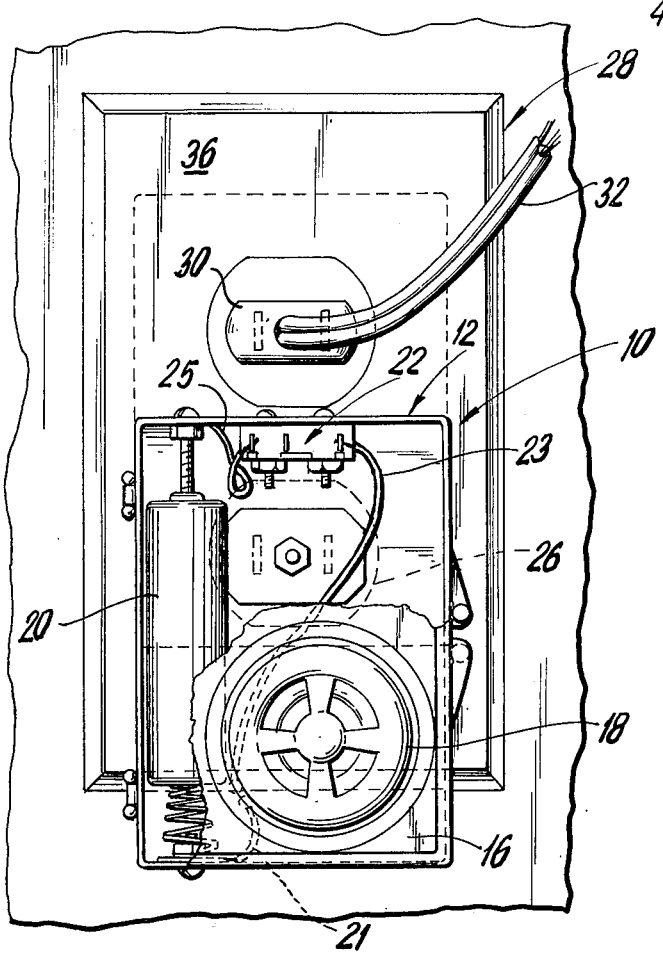
FIG. 1 is a front elevational view of the audible alarm system according to the present invention with parts broken away and mounted in a plug socket of an electrical outlet, leaving the other plug socket free for insertion of a plug.
Figure 2:
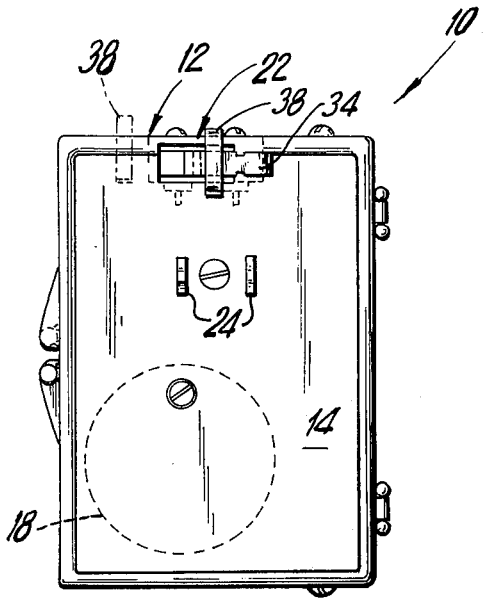
FIG. 2 is a rear elevational view of the audible alarm system according to the present invention.

Referring to FIGS. 1 and 2, the audible alarm system according to the present invention is illustrated generally at 10. The audible alarm system 10 includes a housing 12 having a bottom portion 14 hinged to a top portion 16. Mounted on the top portion 16 is an audible alarm or buzzer 18. The audible alarm 18 is electrically coupled to one terminal of a direct current battery, e.g., a 1.5 volt battery 20 (It should be recognized that two or more batteries may be used, for instance two 1.5 volt batteries, and that higher voltage batteries can be used, for instance a 9 volt battery.) via lead 21 and electrically coupled to one terminal of a pressure responsive switch 22 via lead 23. The other terminal of the pressure responsive switch 22 is coupled to the other terminal of the battery 20 via lead 25.

Referring particularly to FIG. 2, prongs 24 are mounted on the bottom portion 14 of the housing 12 and extend outwardly therefrom to be received in a plug socket 26 of an electrical outlet 28, see FIG. 1. As shown in FIG. 1, the housing 12 is arranged in the plug socket 26 to extend downwardly to cover and prevent access to only plug socket 26 of the electrical outlet 28. The other plug socket 30 is shown electrically coupled to a plug 32 (dotted outline). In the event plug socket 30 is not in use, the housing 12 is arranged in the plug socket 26 (or 30) to cover both sockets 26 and 28 (dotted outline).

The pressure responsive switch 22 includes an outwardly extending member 34 which is depressed by contact with the electrical outlet 28, particularly the switch plate 36, upon insertion of the prongs 24 into plug socket 26 or 30, to open the pressure responsive switch 22 and the circuit to the alarm 18. However, when the housing 12 is withdrawn from the electrical outlet 28 and the outwardly extending member 34 is allowed to return to its normal position, the pressure responsive switch 22 is closed, resulting in a buzzing sound which is unpleasant to the ears, particularly the ears of children.

As further shown in FIG. 2, it is desirable to provide a means for deactivating the alarm system 10 when it is not positioned in an electrical outlet 28. Deactivation of the alarm system 10 is accomplished by a U-shaped clip 38 positioned on the housing 12 and slidable therealong to contact and hold the outwardly extending member 34 in a depressed position to open the pressure responsive switch 22. Additionally, it should be understood that a pivotable arm member could be mounted on the bottom portion and located below the outwardly extending member 34 for movement into engagement therewith for opening the pressure responsive switch 22.

Figure 3:
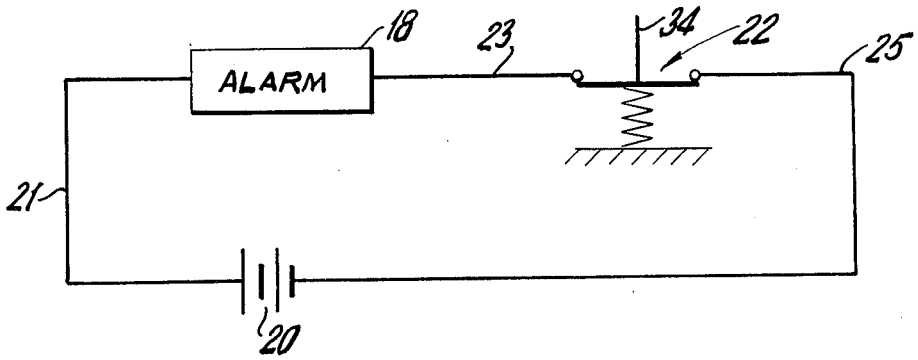
FIG. 3 is a schematic diagram of the circuit for the audible alarm system.

Referring fo FIG. 3, the circuit to the alarm 18 is normally closed by the pressure responsive switch 22.

Referring to FIG. 3, the circuit to the alarm 18 is normally closed by the pressure responsive switch 22. Depression of the outwardly extending member 34, e.g., by the switch plate 36 of the electrical outlet 28, will de-energize the alarm 18. Upon removal of the pressure on the outwardly extending member 34, i.e., when a child is attempting to remove the alarm system 10 from a plug socket, the alarm 18 is energized to emit a buzzing sound. To deactivate the alarm system 10 when it is not installed in an electrical outlet, a U-shaped clip 38 is moved into position to depress the outwardly extending member 34 and open the pressure responsive switch 22. Prior to or after insertion of the alarm system 10 into a plug socket, the U-shaped clip 38 is moved away from contact with the outwardly extending member 34 (dotted outline in FIG. 2).

Figure 4:
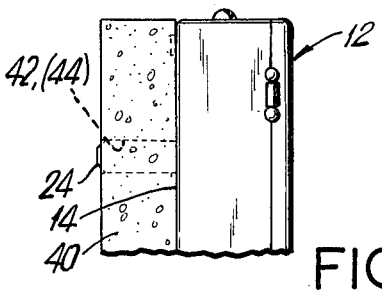
FIG. 4 is a fragmentary side elevational view of the audible alarm system with a backing member.

Referring to FIG. 4, in lieu of the previously described deactivating means, a removable backing member 40, advantageously comprised of a moldable material, e.g., a moldable plastic such as styrofoam, is mounted on housing 12 in contact with the bottom portion 14. The backing member includes a pair of orifices 42 and 44 which receive the prongs 24 when the backing member is mounted on the housing 12. Advantageously, the backing member 40 is dimensioned to conform to the dimensions of housing 12 and is of a thickness to substantially cover the prongs 24 to facilitate packaging of the audible alarm system 10. It is understood that the backing member is removed prior to utilization of the herein-disclosed alarm system.

It should be apparent from the foregoing description that the alarm system 10 according to the present invention may be readily used to cover one plug socket or two (dotted outline in FIG. 1), as desired. Moreover, the present invention provides positive warning when a child is tampering with an electrical outlet and further discourages the child to continue tampering by emitting a buzzing alarm which is unpleasant to the ears.

It should be understood by those skilled in the art that various modifications may be made in the present invention without departing from the spirit and scope thereof as described in the specification and defined in the appended claims.

What is claimed is:

1. An audible alarm system for electrical outlets, comprising:

a housing dimensioned to prevent access to the plug socket of an electrical outlet upon mounting thereon;

means coupled to said housing for insertion into the plug socket for mounting said housing on said plug socket;

alarm means in said housing for providing an audible alarm; and pressure responsive switch means having an outwardly extending portion capable of being engaged and depressed by the electrical outlet upon mounting onto the plug socket to open the circuit to the alarm means and deactivate the same and during withdrawal of said housing from the plug socket, said outwardly extending member moving to close said pressure responsive switch means and therefore the circuit to the alarm means to provide an audible alarm.

2. The audible alarm system claimed in claim 1, wherein:

said alarm means includes a buzzer and a battery electrically coupled to said buzzer, said buzzer being mounted on said housing on the side opposite to said plug socket insertion means.

3. The audible alarm system claimed in claim 1, wherein:

said housing has a hinged bottom portion and a hinged top portion for access to said alarm means.

4. The audible alarm system claimed in claim 1, including:

means for deactivating said alarm means.

5. The audible alarm system claimed in claim 4, wherein:

said deactivating means includes a U-shaped clip slidable into position over said outwardly extending member.

6. The audible alarm system claimed in claim 4, wherein:

said deactivating means includes a removable backing member.

7. The audible alarm system claimed in claim 6 wherein:

said backing member is comprised of a moldable material.

8. An audible alarm system for electrical outlets, comprising:

a housing having a hinged top portion and hinged bottom portion, said housing dimensioned to prevent access to the plug socket of an electrical outlet upon mounting thereon;

means coupled to the bottom portion of said housing for insertion into the plug socket for mounting said housing on said plug socket;

alarm means in said housing for providing an audible alarm, said alarm means including a battery and a buzzer electrically coupled to said battery, a portion of said buzzer extending outwardly from said hinged top portion of said housing;

pressure responsive switch means for normally completing a circuit to said buzzer to activate the same, said pressure responsive switch means having an outwardly extending portion capable of being engaged and depressed by the electrical outlet upon mounting onto the plug socket to open the circuit to said buzzer and deactivate the same and during withdrawal of said housing from the plug socket, said outwardly extending member moving to close said pressure responsive switch means and therefore the circuit to said buzzer and provide an audible alarm; and means for deactivating said alarm means.

* * * * *